United States Patent [19]

Jacobs

[11] Patent Number: 4,633,807

[45] Date of Patent: Jan. 6, 1987

[54] ELECTROGRAPHIC DEVELOPMENT STATION WITH IMPROVED DEVELOPER MIXER AND SKIVE

[75] Inventor: Michael E. Jacobs, Henrietta, N.Y.

[73] Assignee: Eastman Kodak Company, Rochester, N.Y.

[21] Appl. No.: 807,721

[22] Filed: Dec. 11, 1985

[51] Int. Cl.[4] ..... G03G 15/09

[52] U.S. Cl. ..... 118/657

[58] Field of Search ..... 118/657, 658

[56] References Cited

U.S. PATENT DOCUMENTS 3,640,248 2/1972 Nielander ..... 118/637

4,481,903 11/1984 Haberhauer ..... 118/653

FOREIGN PATENT DOCUMENTS 102889 8/1974 Japan .

*Primary Examiner*—Bernard D. Pianalto

*Attorney, Agent, or Firm*—G. Herman Childress

[57] ABSTRACT

A development station applies developer material to a latent image on a photoconductor of an electrographic apparatus. An applicator in the station receives developer material from a sump and provides it to the latent image, and excess developer material from the applicator travels along a skive and is returned to the sump. A developer mixer in the sump includes a plurality of blades which are driven about an axis to mix the developer material and supply such material to the applicator. One of the mixer blades is longer than the other blades and strikes the skive during rotation of the mixer to flex the skive and thus facilitates movement of any developer material on the skive toward the sump. The longer blade of the mixer also engages an arcuate surface of the sump during rotation of the blade to wipe developer material from that surface, and removes excess developer from part of the applicator.

5 Claims, 2 Drawing Figures

ELECTROGRAPHIC DEVELOPMENT STATION WITH IMPROVED DEVELOPER MIXER AND SKIVE

BACKGROUND OF THE INVENTION

The invention relates to an electrographic development station and, more particularly, to such a station having an improved mixer for developer material.

Electrographic apparatus, such as copier/duplicators, have a development station for applying developer material to a latent image on one surface of a photoconductor as the image is advanced past the station. A development station may comprise a sump for holding a supply of developer material, an applicator such as a magnetic brush for supplying such material to the latent image on the photoconductor, and a skive for removing any excess developer material from the applicator and returning it to the sump. The developer material in the sump may comprise a two-component developer consisting of carrier particles and relatively smaller toner particles. A mixer in the sump thoroughly mixes the two-components of the material together to triboelectrically charge the material prior to delivery of the material to the magnetic brush. The mixer may take various forms, including paddle wheel type mixers, augers, etc. It also is known to provide an impeller having a plurality of projecting blades of equal length for delivering developer material from the sump to a magnetic brush. Electrographic apparatus having a development station as generally discussed above is disclosed, for example, in U.S. Pat. No. 3,640,248 issued Feb. 8, 1972 in the name of W. B. Nielander and entitled "Electrostatic Magnetic Developing Apparatus."

Prior development stations have worked satisfactorily for developing latent images on a photoconductor. However, there are some problems with prior development stations. In magnetic brush development apparatus a skive may be provided for deflecting developer material from a shell of the magnetic brush after such material has been passed through a development zone located between the brush and the photoconductor. The material thus removed by the skive has a tendency to cling to the surface of the skive instead of quickly dropping back into the sump of the development station. Any developer material that clings to the skive interferes with removal of additional material from the magnetic brush and return of such material to the sump.

Another problem with development stations of electrographic apparatus is that developer material in the bottom of the sump is difficult to reach and move with existing mixers. As a result, a certain portion of the developer material is effectively not available for developing latent images. Such can be tolerated in development stations having sumps with relatively large capacities; however, for smaller development stations it is important to be able to utilize substantially all of the developer material in the sump so that the sump does not have to be frequently refilled by the machine operator.

A further problem with prior apparatus is that a magnetic brush may accumulate excess developer material in an area spaced from the development zone. Such can result in high torque requirements, eddy currents and high heat in the development station.

SUMMARY OF THE INVENTION

Accordingly it is an object of the invention to provide an improved development station for electrographic apparatus wherein developer material removed from an applicator by a skive is quickly returned to the sump.

Another object of the invention is to provide an improved mixer for developer material in the sump of an electrographic development station which assures mixing of virtually all developer material in the sump and makes substantially all of such material available for transfer to the applicator.

A further object of the invention is to effectively remove excessive developer material from a magnetic brush.

In accordance with the present invention an improved development station is provided for applying developer material to a latent image on a photoconductor of an electrographic apparatus. The station has a sump for holding a supply of developer material, and an applicator for supplying such material to the latent image on the photoconductor. A flexible skive removes excess developer material from the applicator so that it can be returned to the sump. The improved development station includes mixing means located in the sump and having a plurality of blades that are rotated by drive means about an axis. The blades are effective when rotated to mix developer material in the sump and supply developer material from the sump to the applicator. At least one of the blades on the mixer is of sufficient length to strike the skive during rotation of the mixing means to flex the skive and cause developer material on the skive to be returned to the sump. In a preferred embodiment of the invention the longer blade of the mixer is engageable with an arcuate surface forming the bottom of the sump to wipe developer material from that surface so that it can be mixed with other such material in the sump and made available to the applicator for developing latent images.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

Figure 1:
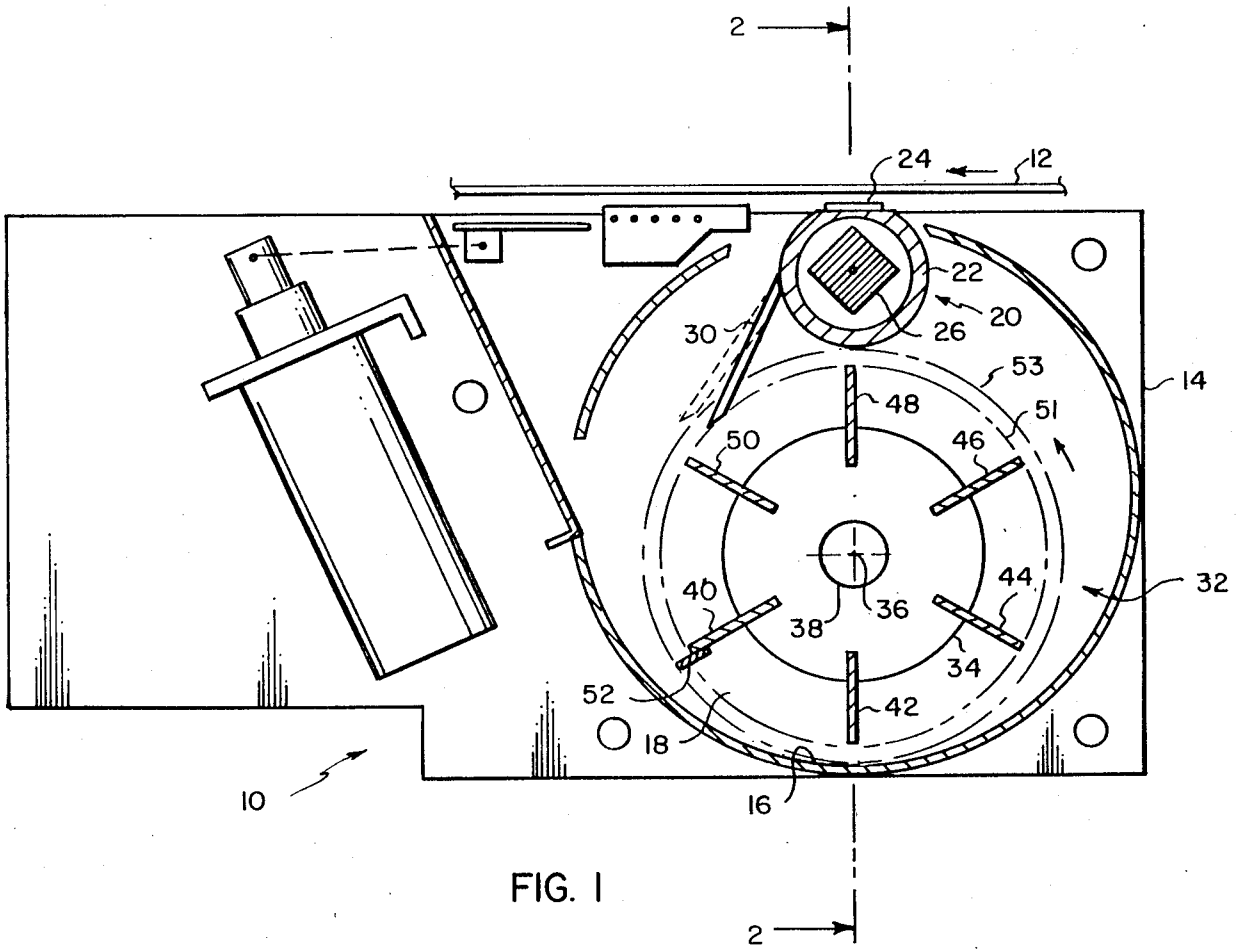
FIG. 1 is a transverse cross section view through an electrographic development station of the present invention.

A development station 10 of the present invention is used for applying developer material to a latent image formed on a photoconductor 12 of electrographic apparatus as the photoconductor is advanced past the station 10. Development station 10 comprises a housing 14 having a generally semi-cylindrical inner wall 16 that defines a sump 18 for holding a supply of developer material, such as a two component developer material comprising carrier particles and toner particles.

Developer material from the sump is applied to a latent image on the photoconductor by an applicator generally designated 20. The applicator 20 illustrated in the drawings is a magnetic brush comprising a stationary outer shell 22. The shell generally is cylindrical in configuration but has a relatively flat surface 24 at the top of the shell and immediately beneath the path for the photoconductor past the magnetic brush. The development zone lies between the flat top 24 and the photoconductor. The magnetic brush further comprises a single magnet 26 of rectangular cross section that is positioned within the shell 22 and is rotatable in a clockwise direction within the shell so that developer material from the sump reaching the bottom part of shell 22 moves in a counterclockwise direction around the shell to the development zone where it is available for transfer to a latent image on the photoconductor 12.

Some developer material provided to the development zone is not transferred to the photoconductor. Such material continues to rotate in a counterclockwise direction around shell 22 of the magnetic brush until it reaches a skive 30. The skive extends the full length of the sleeve 22 and has an upper edge that is secured to the sleeve. The skive extends downwardly from the sleeve at an incline angle with respect to a vertical plane through the station 10. Thus developer material moving from the development zone reaches the skive and is deposited along the outer (left) surface of the skive so that it can be returned to the sump 18 for reuse. The skive preferably comprises a very thin, flexible material so that it can be flexed to remove material from the skive in the manner described in more detail hereinafter.

A paddle wheel type mixer 32 is located within housing 14. The mixer is effective to triboelectrically charge the carrier and toner particles of the developer material and provide them to the applicator 20. Mixer 32 comprises a pair of generally cylindrical hubs 34 at the ends of the mixer which are rotatable about an axis 36. As is apparent from FIG. 1, axis 36 is offset from the axis of curvature of wall 16. As best shown in FIG. 2, the hubs are secured to a shaft 38 which is journaled in end plates 40, 41 of housing 14 for rotation about the axis 36. A drive pulley 45 is secured to one end of the shaft 38 and driven from a motor (not shown) to rotate the mixer in a counterclockwise direction as viewed in FIG. 1.

The mixer has a plurality of blades 40, 42, 44, 46, 48 and 50 mounted in the hubs 34. The blades lie in planes extending through the axis 36. There is an open space in the center of the mixer between the hubs 34 and the radially inner ends of the blades 40–50. This provides sufficient room for the developer material within the sump to be circulated thoroughly in response to rotation of the mixer. During rotation of the mixer the developer material is not only agitated and triboelectrically charged, but it also is delivered by the mixer to the applicator 20 for transport to the photoconductor.

Figure 2:
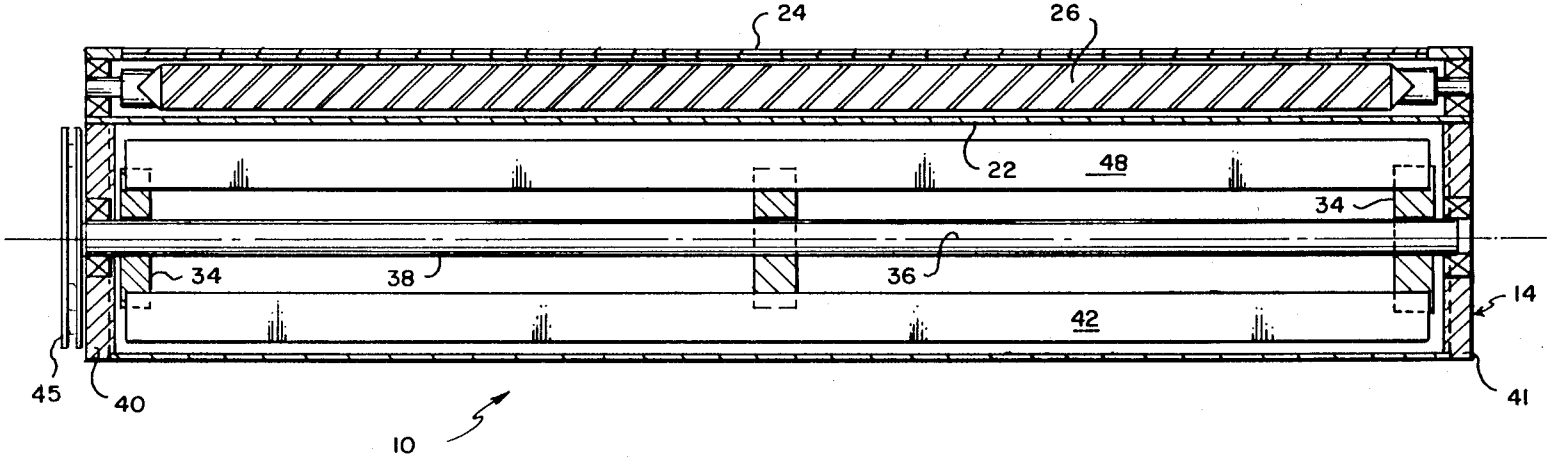
FIG. 2 is a longitudinal cross section taking along line 2—2 in FIG. 1.

As shown in FIG. 1, blades 42–50 are substantially identical in size and project the same radial distance from axis 36. Blade 40, on the other hand, has a greater length in a radial direction. As a result, the radially outer edges of blades 42–50 sweep through a circle 51 while the radially outer edge of blade 40 sweeps through a larger circle 53. The greater length for blade 40 can be achieved by forming the blade 40 of a different size in the first instance, or by securing an elongate extension 52 to the radially outer portion of a blade like blades 42–50. The extension 52, or all of blade 40, can be flexible.

As the mixer 32 is rotated during operation, the extension 52 of blade 40 wipes along the lowermost part of the bottom wall 16 of housing 14 to thereby remove any developer material resting on the bottom of the sump. The outer extremity of blades 42–50, on the other hand, are spaced from the wall 16 during their rotation. Thus in the absence of the extension 52 some developer material would tend to accumulate in the bottom of the sump and not be utilized for development of images on the photoconductor.

During rotation of the mixer, the extension 52 of blade 40 also strikes any developer material on the bottom of the shell 22 of applicator 20 and the lower end portion of the skive 30. As the extension on blade 40 wipes across the shell 22, it removes excess developer materials that may be present on the bottom of the shell. Accumulation of developer material on the shell can increase the torque required to drive the magnet 26, thereby increasing power requirements and producing undesirable heat within the development station. In addition, removal of such material will reduce eddy currents and insure a continuous supply of fresh developer to the development zone.

As developer material returns from the development zone to skive 30, the material may tend to accumulate on the skive. Such accumulation can result from friction or from magnetic attraction of the material toward the magnet 26. When extension 52 of blade 40 strikes the skive 30, it flexes and physically moves the skive 30, thereby jarring loose developer material that may be clinging to the outer surface of the skive. Such material then slides along the outer surface of the skive and is returned to the sump where it is thoroughly mixed with developer material remaining in the sump by the blades 40–50.

Thus the extension 52 on blade 40 wipes the bottom of the sump to insure that all the developer material is utilized for developing images. It also removes excess developer material from the bottom circumferential portion of the shell 22 of the applicator and ensures the return of developer material to the sump that might otherwise cling to the outer surface of the skive 30.

Extension 52 of blade 40 preferably is somewhat flexible so that it can yield when it wipes across wall 16 of the housing or strikes the shell 22 of the applicator.

In operation, the photoconductor 12 is driven past the development station in the direction indicated by the arrow in FIG. 1. Mixer 32 is rotated in a counterclockwise direction so that the blades 40–50 thoroughly mix the developer material in sump 18 and triboelectrically charge the material to prepare it for delivery to the development zone. The blades also physically transport the developer material to the shell 22 of the magnetic brush, and rotation of magnet 26 in a clockwise direction advances the developer material counterclockwise to the development zone between the flat top 24 of the shell and the photoconductor. Any unused developer material continues to rotate around the shell until it reaches the skive 30 and moves along the surface of the skive. The longer blade 40 of the mixer strikes the skive to flex it and physically move it to thereby return developer material from the skive into the sump 18. Blade 40 also wipes against wall 16 and shell 22 as explained hereinbefore to ensure that all material in the sump can be utilized for development of images and to return to the sump excessive developer material from the lower quadrant of the shell.

The invention has been described in detail with particular reference to a preferred embodiment thereof, but it will be understood that variations and modifications can be effected within the spirit and scope of the invention as described here and above and as defined in the appended claims.

I claim:

1. In a development station for applying developer material to a latent image on a photoconductor of an electrographic apparatus, the station having a sump for holding a supply of developer material, an applicator for supplying such material to the latent image on the photoconductor, and a flexible skive in engagement with the applicator for removing excess developer material from the applicator so that it can be returned to the sump, the improvement comprising:

mixing means in the sump, the mixing means comprising a plurality of blades and drive means for rotating the blades about an axis, the blades being effective when rotated to mix developer material in the sump and supply developer material from the sump to the applicator, and at least one of the blades being of sufficient length to strike the skive during rotation of the mixing means, thereby to flex the skive and cause developer material on the skive to be returned to the sump.

2. The invention as set forth in claim 1 wherein the one blade of the mixing means is longer than other blades of the mixing means.

3. The invention as set forth in claim 2 wherein the sump has an arcuate bottom surface, and the one blade is engageable with the surface during rotation of the mixing means to wipe developer material from the surface.

4. The invention as set forth in claim 1 wherein the applicator comprises a magnetic brush having a stationary outer shell and a rotatable magnetic core, the skive has an elongate edge secured to the shell, and the shell being positioned with respect to the mixing means (1) to receive developer material directly from the mixing means and (2) to have excess developer material removed from the portion of the shell nearest the mixing means by the one blade during rotation of the blades.

5. The invention as set forth in claim 1 wherein the mixing means comprises a pair of spaced circular hubs mounted for rotation about their axes, the blades being flat and being secured to the hubs with the blades projecting generally radially from the axis of rotation, and the one blade comprises a blade similar to other blades of the mixing means with an elongate extension secured to the radially outer edge thereof so that the outer portion of the extension sweeps through a circular path having a greater diameter than the path taken by the other blades during rotation of the mixing means.

* * * * *